US008041235B2

(12) United States Patent
Ueda

(10) Patent No.: US 8,041,235 B2
(45) Date of Patent: Oct. 18, 2011

(54) IMAGE FORMING APPARATUS, ADJUSTING METHOD THEREOF AND REPLACEMENT COMPONENT THEREOF

(75) Inventor: Hiroki Ueda, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 450 days.

(21) Appl. No.: 12/100,310

(22) Filed: Apr. 9, 2008

(65) Prior Publication Data

US 2008/0298819 A1 Dec. 4, 2008

(30) Foreign Application Priority Data

Jun. 1, 2007 (JP) ..... 2007-146495

(51) Int. Cl.
*G03G 15/00* (2006.01)

(52) U.S. Cl. ..... 399/12; 399/9; 399/24; 399/31

(58) Field of Classification Search ..... 399/9, 11, 399/12, 13, 24, 25, 31
See application file for complete search history.

(56) References Cited

U.S. PATENT DOCUMENTS 6,301,449 B1 * 10/2001 Miura ..... 399/12
2004/0136025 A1 * 7/2004 Moriyama et al. ..... 358/1.14
2005/0244169 A1 * 11/2005 Ono ..... 399/12

FOREIGN PATENT DOCUMENTS

JP 2004-148714 5/2004
JP 2005-335164 12/2005

* cited by examiner

*Primary Examiner* — David Porta
*Assistant Examiner* — Jessica L Eley
(74) *Attorney, Agent, or Firm* — Finnegan, Henderson, Farabow, Garrett & Dunner, LLP

(57) ABSTRACT

Disclosed is an image forming apparatus in which a replacement component is set including the replacement component in which a storage medium storing adjustment necessity information indicating whether an adjustment procedure is needed or not after the replacement component is replaced and adjustment item information indicating an adjustment item is attached, an information reading unit to read the adjustment necessity information and the adjustment item information from the storage medium when the replacement component is set and a control unit to execute the adjustment procedure based on the adjustment necessity information and the adjustment item information read by the information reading unit when a power is turned on after the replacement component is replaced.

8 Claims, 8 Drawing Sheets

FIG. 2

141

| No. | COMPONENT TYPE INFORMATION | ADJUSTMENT NECESSITY INFORMATION | ADJUSTMENT ITEM INFORMATION | ... |
|---|---|---|---|---|
| 1 | OPTICAL UNIT | YES | COLOR RESIST ADJUSTMENT | ... |
| 2 | IMAGE FORMING UNIT | YES | COLOR RESIST ADJUSTMENT | ... |
| 3 | FIXING UNIT | YES | FIXING LINE SPEED ADJUSTMENT | ... |
| ⋮ | ⋮ | ⋮ | ⋮ | ... |

FIG. 7

142

| COMPONENT TYPE INFORMATION | SERIAL NUMBER |
|---|---|
| OPTICAL UNIT | 1000010 |
| FIXING UNIT | 2000005 |
| ⋮ | ⋮ |

IMAGE FORMING APPARATUS, ADJUSTING METHOD THEREOF AND REPLACEMENT COMPONENT THEREOF

BACKGROUND OF THE INVENTION

1. Field of the Invention

The present invention relates to an image forming apparatus and an adjustment method and replacement components of the image forming apparatus.

2. Description of Related Art

Conventionally, in an image forming apparatus, various types of adjustments are carried out so that the image forming apparatus can operated stably even after the replacement component is replaced as the replacement component is replaced. There are cases where the adjustment item which needs to be adjusted is different for each replacement component to be replaced. Therefore, a user and a serviceman have been carrying out the adjustment of the adjustment item corresponding to the replaced replacement item by instructing the adjustment item corresponding to the replaced replacement item by the operation panel or the like.

However, missing of adjustment may occur when the adjustment item is instructed manually. Therefore, as for a technique to solve such missing of adjustment, for example, there is suggested a technique in which the adjustment item which is needed when the selected replacement component is replaces is decided and in which the adjustment is carried out in the image forming apparatus when a user or a serviceman selects the replacement component to be replaced manually by the operation panel or the like (for example, see JP2004-148714A (hereinafter, called patent document 1), JP2005-335164A (hereinafter, called patent document 2)).

In the inventions described in Patent documents 1 and 2, an operation of a person such as a user, a serviceman or the like is required. Therefore, there may be an error operation such as a miss selection or a missing of selection of the replacement component and the like, and the manual operation is not enough to prevent the missing of adjustment. Further, when the adjustment item is changed by the component being added, the version upgrading, and the like, it is complicated because an operation of updating of the software and the like in the image forming apparatus side is required. Further, there was a possibility that the missing of adjustment may occur and unnecessary adjustments may be executed unless the software is appropriately updated.

SUMMARY OF THE INVENTION

An object of the present invention is to reduce the work of a user or a serviceman according to the component replacement and to prevent the missing of adjustment after the replacement component is replaced.

To solve the above problem, in accordance with the first aspect, an image forming apparatus in which a replacement component is set comprises the replacement component in which a storage medium storing adjustment necessity information indicating whether an adjustment procedure is needed or not after the replacement component is replaced and adjustment item information indicating an adjustment item is attached, an information reading unit to read the adjustment necessity information and the adjustment item information from the storage medium when the replacement component is set and a control unit to execute the adjustment procedure based on the adjustment necessity information and the adjustment item information read by the information reading unit when a power is turned on after the replacement component is replaced.

In accordance with the second aspect, an adjustment method of an image forming apparatus in which a replacement component is set comprises reading adjustment necessity information indicating whether an adjustment procedure is needed or not after a replacement component is replaced and adjustment item information indicating an adjustment item from a storage medium attached to the replacement component by an information reading unit when the replacement component is set and executing the adjustment procedure based on the adjustment necessity information and the adjustment item information which are read when a power is turned on after the replacement component is replaced.

In accordance with the third aspect, a replacement component which is to be set in an image forming apparatus comprises a storage medium in which adjustment necessity information indicating whether an adjustment procedure is needed or not after the replacement component is replaced and adjustment item information indicating an adjustment item are stored is attached, and the adjustment necessity information and the adjustment item information are read from the storage medium by an information reading unit when the replacement component is set and the adjustment procedure is executed based on the adjustment necessity information and the adjustment item information which are read by the information reading unit when a power is turned on after the replacement component is replaced.

According to the present invention, the work of a user or a serviceman according to the component replacement can be reduced and the missing of adjustment after the component replacement can be prevented in the image forming apparatus.

BRIEF DESCRIPTION OF THE DRAWINGS

The present invention will become more fully understood from the detailed description given hereinbelow and the appended drawings, and thus are not intended as a definition of the limits of the present invention, and wherein:

FIG. 2 is a diagram showing an example of data storage of a replacement component information file which is stored in a storage unit of FIG. 1:

FIG. 7 is a diagram showing an example of a data storage of a component management information file which is stored in the storage unit of FIG. 1 in the third embodiment.

DESCRIPTION OF THE PREFERRED EMBODIMENTS

First Embodiment

Hereinafter, the first embodiment of the present invention will be explained in detail with reference to the drawings.

First, the structure will be described.

Figure 1:
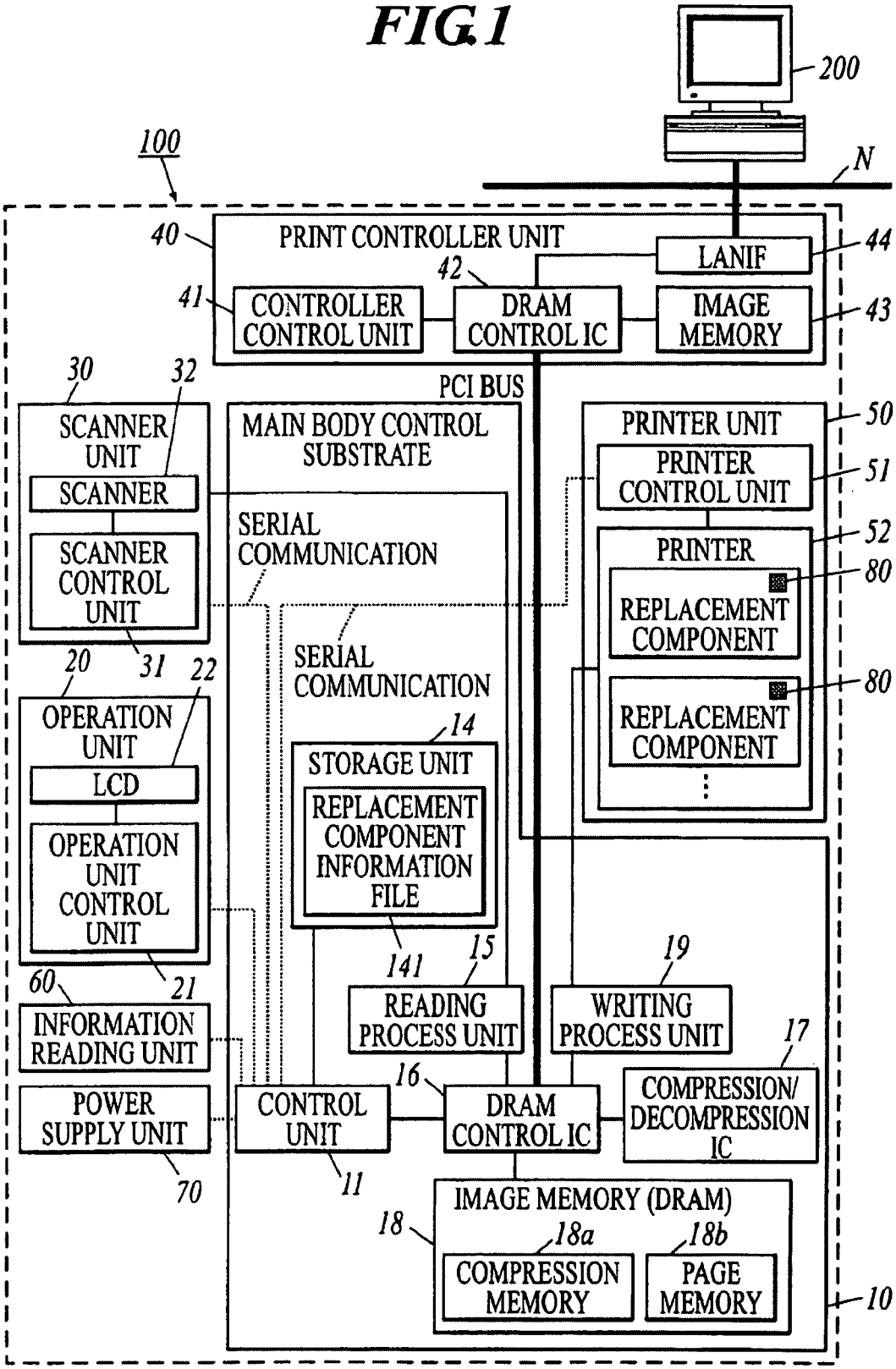
FIG. 1 is a block diagram showing a functional structure of an image forming apparatus in an embodiment of the present invention.

An example of a functional structure of the image forming apparatus 100 in the embodiment of the present invention is shown in FIG. 1.

As shown in FIG. 1, the image forming apparatus 100 comprises a main body control substrate 10, an operation unit 20, a scanner unit 30, a print controller unit 40, a printer unit 50, an information reading unit 60, a power supply unit 70 and the like.

The main body control substrate 10 comprises a control unit 11, a storage unit 14, a reading process unit 15, a DRAM (Dynamic Random Access Memory) control IC 16, a compression/decompression IC 17, an image memory (DRAM) 18, a writing process unit 19 and the like.

The control unit 11 comprises the CPU (Central Processing Unit), the ROM (Read Only Memory), the RAM (Random Access Memory) and the like. The component replacement mode process program, various types of process programs such as the adjustment process program and others, the adjustment program for each adjustment item which needs to be executed according to the component replacement and the like in the image forming apparatus 100 and the like are stored in the ROM of the control unit 11. The CPU of the control unit 11 reads various types of programs stored in the ROM and expands the programs in the RAM, and controls the operation of each unit of the image forming apparatus 100 according to the expanded programs.

The storage unit 14 is constituted of a non-volatile memory or the like and stores various types of data according to the instruction from the control unit 11. As shown in FIG. 1, the storage unit 14 includes the replacement component information file 141.

An example of data storage of the replacement component information file 141 is shown in FIG. 2. The replacement component information file 141 is a file to store the replacement component information which is read and obtained by the information reading unit 60 from the IC tag 80 which is a storage medium attached to the replacement component to be installed at the time of component replacement. For example, the replacement component information includes the identification information (component type information) which specifies the type of the component, the information (adjustment necessity information) indicating whether the adjustment after the component replacement is needed or not and the information indicating the required adjustment item (adjustment item information). As shown in FIG. 2, the replacement component information file 141 includes the "component type information" field to store the component type information, the "adjustment necessity information" field to store the adjustment necessity information, the "adjustment item information" field to store the adjustment item information and the like, and the replacement component information file 141 stores the replacement component information read from one IC tag 80 as one record.

The reading process unit 15 converts the analog image signal read by the scanner unit 30 into the image data of R, G and B. Further, the reading process unit 15 carries out the image process such as converting the image data into the density linear from the brightness linear, converting the image data into the C, M, Y and K image data from the R, G and B image data and the like. Then, the reading process unit 15 outputs the data to the DRAM control IC 16.

The DRAM control IC 16 compresses the image data input from the reading process unit 15 and the image data input from the print controller unit 40 by the compression/decompression IC 17 based on the control from the control unit 11, and writes and temporarily stores the compressed image data in the compression memory 18*a* of the image memory 18. Further, when the image data output is instructed from the control unit 11, the DRAM control IC 16 decompresses the image data stored in the compression memory 18*a* by the compression/decompression IC 17, and stores the decompressed image data in the page memory 18*b*. Then, reads the image data stored in the page memory 18*b* and outputs the read image data to the writing process unit 19 according to the instruction from the control unit 11.

The compression/decompression IC 17 is the IC to carry out the compression process and the decompression process to the image data by the control of the DRAM control IC 16.

The image memory 18 is constituted of the DRAM and includes the compression memory 18*a* and the page memory 18*b*. The compression memory 18*a* temporarily stores the image data compressed by the compression/decompression IC 17 by the control of the DRAM control IC 16. The page memory 18*b* temporarily stores the image data decompressed by the compression/decompression IC 17.

The writing process unit 19 generates the PWM (Plus Width Modulation) signal based on the image data input from the compression/decompression IC 17 and outputs the signal to the printer unit 50.

The operation unit 20 comprises the operation control unit 21 and the LCD (Liquid Crystal Display) 22.

The operation control unit 21 receives the display signal from the control unit 11 and carries out the display control in the LCD 22. Further, the operation control unit 21 outputs the operation signal which is input from the touch panel on the LCD 22 to the control unit 11.

The LCD 22 is the display unit to carry out the display of various types of operation screens, the screen condition display, operation condition of various types of functions and the like according to the instruction of the display signal input from the operation control unit 21. A pressure sensitive type (resistance film pressure type) touch panel in which the clear electrodes are disposed in lattice constitutes the screen surface of the LCD 22, and detects the XY coordination of the power point which is pressed by a finger, a touch pen or the like by a voltage value, and outputs the detected position signal to the operation control unit 21 as an operation signal. For example, the LCD 22 displays the operation screen to set the operation mode of the control unit 11 to the component replacement mode according to the instruction of the display signal input from the operation control unit 21. The operation mode of the control unit 11 is set to the component replacement mode by the setting operation from the operation screen. Further, the LCD 22 displays the screen which shows the procedure for carrying out the replacement of the replacement component according to the instruction of the display signal input from the operation control unit 21 in the component replacement mode.

The operation unit 20 further comprises various types of operation buttons such as the main power button, the number buttons, the start button and the like which are omitted from the drawing, and outputs the operation signal by the button operation to the control unit 11 from the operation control unit 21.

The scanner unit 30 comprises the scanner control unit 31 and the scanner 32.

The scanner control unit 31 receives the control signal from the control unit 11 and controls the drive of each unit of the scanner 32. The scanner 32 comprises the platen glass, the CCD (Charge Coupled Device) and the light source, and reads the image of the document set at a predetermined position as the R, G and B signals by forming an image by the CCD using the reflected light of the light used for the illumination scanning from the light source to the document and by carrying out the photoelectric conversion and outputs the read analog image signal to the reading process unit 15.

The print controller unit 40 is constituted of the controller control unit 41, the DRAM control IC 42, the image memory 43 and the LAN IF 44.

The controller control unit 41 integrally controls the operation of each unit of the print controller unit 40. Further, the controller control unit 41 converts the image data input from the host computer 200 via the LAN IF 44 into the data format image data of Y, M, C and K in which an image can be formed in the image forming apparatus 100 in a predetermined page-description language and outputs the converted data to the DRAM control IC 42 along with the setting information of the image forming condition input from the host computer 200.

The DRAM control IC 42 carries out the control to temporarily store the image data and the setting information in the image memory 43 according to the instruction from the controller control unit 41. Further, the DRAM control IC 42 is connected with the DRAM control IC 16 by the PCI (Peripheral Components Interconnect) bus, and reads the image data and the setting information from the image memory 43 and outputs the data and the information to the DRAM control IC 16 according to the instruction from the controller control unit 41.

The image memory 43 is constituted of the DRAM, and temporarily stores the inputted data.

The LAN IF 44 is constituted of the NIC (Network Interface Card), the modem and the like, and carries out the sending and receiving of the data such as the image data between the host computer 200 which is connected to the communication network N such as the LAN (Local Area Network) or the like. The data received from the host computer 200 is output to the DRAM control IC 42.

The printer unit 50 is constituted of the printer control unit 51 and the printer 52.

The printer control unit 51 receives the control signal from the control unit 11 and controls the operation of each unit of the printer 52.

The printer 52 forms a toner image on the paper based on the image data input from the control unit 11 by the electrophotographic process.

Figure 3:
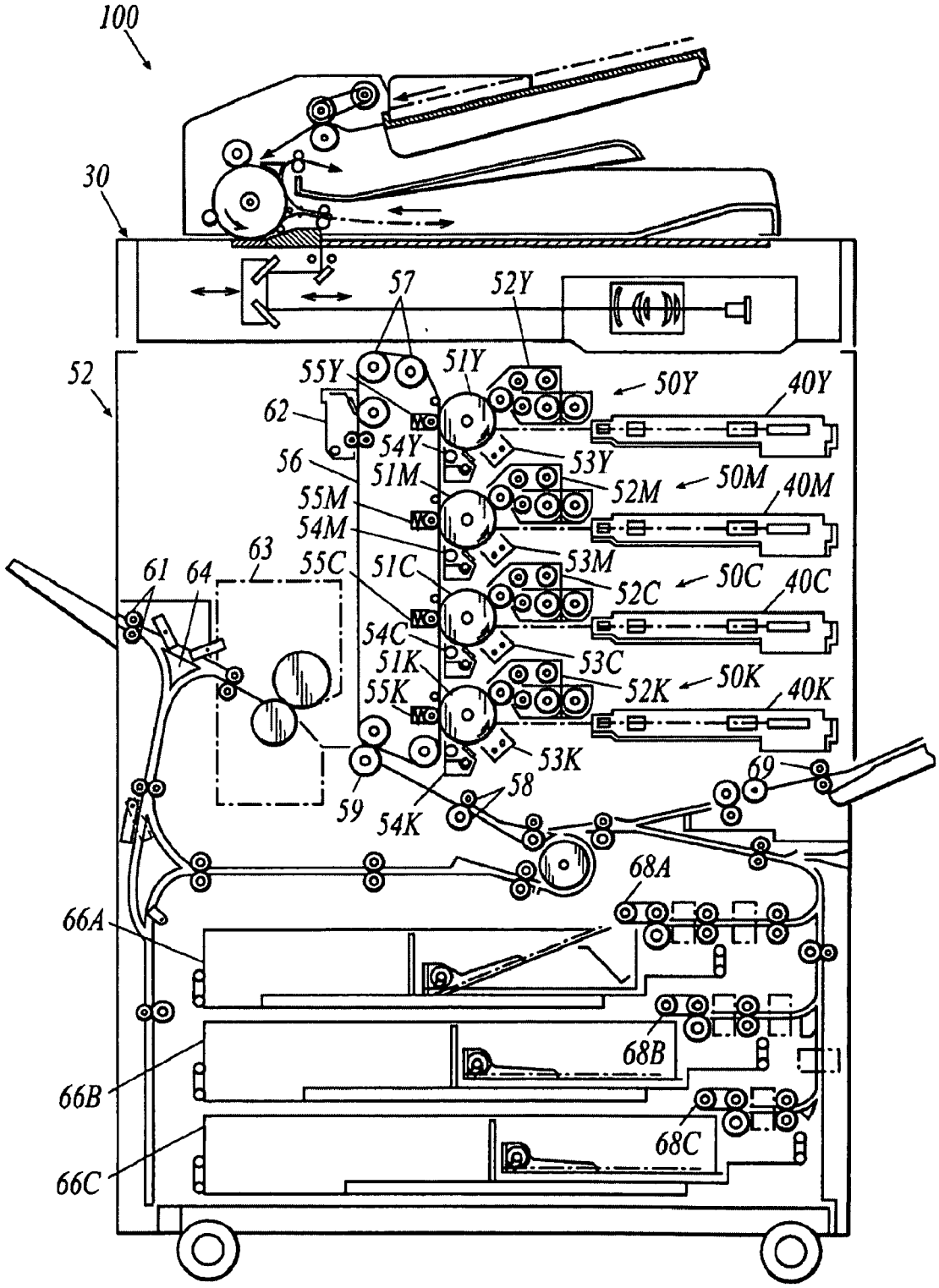
FIG. 3 is a diagram showing a main structure of a printer of FIG. 1.

The main structure of the printer 52 is shown in FIG. 3. As shown in FIG. 3, the printer 52 comprises the optical units 40Y, 40M, 40C and 40K which writes the latent image on the photoconductor drum by exposing the laser to the photoconductor drums 51Y, 51M, 51C and 51K based on the PWM signal input from the writing process unit 19, the image forming units 50Y, 50M, 50C and 50K which form the toner image of each color of Y, M, C and K, the intermediate transfer belt 56 as an intermediate transcript on which the toner images formed in the image forming units 50Y, 50M, 50C and 50K are primarily transferred, the resist roller 58 to convey the paper to the secondary transfer roller 59 by synchronizing with the toner image formed on the intermediate transfer belt 56, the secondary transfer roller 59 to secondarily transfer the toner image formed on the intermediate transfer belt on the paper, the fixing unit 63 to fix the toner image on the paper and the paper ejection roller 61 to eject the paper.

The image forming unit 50Y comprises the photoconductor drum 51Y, the developer 52Y, the charger 53Y, the cleaner 54Y and the primary transfer roller 55Y. The image forming unit 50M, 50C and 50K are also similarly constituted.

Here, the print operation in the printer 52 will be described. First, in the image forming unit 50Y, the photoconductor drum 51Y rotates, the surface of the photoconductor drum 51Y is charged by the changer 53Y, and the latent image of the image of the Y data is formed on the charged part of the photoconductor drum 51Y by the exposure of the laser light source of the optical unit 40Y. Then, the latent image portion is developed by the developer 52Y and the toner image of yellow is formed. The toner image is primarily transferred on the intermediate transfer belt 56 by a pressure of the primary transfer roller 55Y. The toner image becomes a yellow image which corresponds to the image data which is targeted for output. The toner which is not primarily transferred is removed by the cleaner 54Y.

Similarly in the image forming units 50M, 50C and 50K, the toner image of magenta, the toner image of cyan and the toner image of black are respectively formed and transferred in similar way. The intermediate transfer belt 56 is also rotated by the rotation of the roller 57, the primary transfer rollers 55Y, 55M, 55C and 55K and the secondary transfer roller 59, and the toner images of Y, M, C and K are orderly overlaid on the intermediate transfer belt 56 and are transferred. Further, a paper is conveyed from either of the paper feeding trays 66A to 66C, one by one, by the rotation of either of the paper feeding rollers 68A to 68C, and is conveyed to the secondary transfer roller 59 by the rotation of the resist roller 58.

When the paper passes the pressuring part of the secondary transfer roller 59, the toner images of Y, M, C and K on the intermediated belt 56 are secondarily transferred to the paper. The paper in which the toner images of Y, M, C and K are transferred passes the fixing unit 63. By pressuring and heating of the fixing unit 63, the toner images of Y, M, C and K are fixed on the paper and the colored toner image is formed. The paper in which the image is formed is ejected by the paper ejection roller 61.

After the image is formed on the paper, the residual toner on the intermediate transfer belt 56 is removed by the belt cleaning 62. Further, by passing a positive electric current and a negative electric current from the power supply 67 to the secondary transfer roller 59 alternatively for a predetermined length of time by switching, the residual toner on the secondary transfer roller 59 is re-transferred to the intermediate transfer belt 56 and the cleaning of the secondary transfer roller 59 is carried out.

Each unit of the above described printer 52 is connected to the printer control unit 51, and is driven via various types of motors (omitted from the drawing) by the control of the printer control unit 51 by the order of the control unit 11.

Here, the replaceable components (for example, the optical units 40Y, 40M, 40C and 40K, the image forming units 50Y, 50M, 50C and 50K, the fixing unit 63 and the like) are included in the components which constitute the above described printer 52. In the components which constitute the printer 52, there are components that wear out by repeating the image forming operation. These components are replaced with the replacement component by a user or a serviceman as necessary. Because each replacement component has manufacturing tolerances, an adjusting procedure is executed by the control of the control unit 11 when the power is turned on for the first time after the replacement component is replaced so that the apparatus can always operate stably even when the component is replaced with the replacement component.

The necessity of adjustment after the replacement component is replaced and the item of the adjustment to be executed are different according to the type of the component. For example, when the optical units 40Y, 40M, 40C and 40K and the image forming units 50Y, 50M, 50C and 50K are replaced, the color resist adjustment is executed. When the fixing unit 63 is replaced, the adjustment of the fixing linear velocity is executed.

In the embodiment, the IC tag 80 as a storage medium is attached to the replacement component to be set in the image forming apparatus 100. The replacement component information such as the component type information indicating the type of the replacement component, the adjustment necessity information indicating the necessity of adjustment after the replacement component is replaced, the adjustment item information indicating the type of the required adjustment item and the like are stored in the IC tag 80. In the control unit 11, the necessity of the adjustment after the replacement and the required adjustment item are determined based on the replacement component information stored in the IC tag 80 of the replacement component which is set at the replacement.

The information reading unit 60 is constituted of the IC tag reader. The information reading unit 60 transmits the electromagnetic wave (electric power wave) to the IC tag 80 and drives the IC tag 80 by the electromagnetic induction. Then, the information reading unit 60 reads the replacement component information stored in the IC chip of the IC tag 80 and outputs the information to the control unit 11. Here, it is preferred that the communication distance between the information reading unit 60 and the IC tag 80 is more or equal to 1 cm in order to prevent detecting the IC tag 80 attached to the replacement component which is already set in the image forming apparatus 100 or the IC tag 80 attached to the replacement component set near the image forming apparatus 100 by mistake.

The power supply unit 70 is connected to the commercial alternating current power source (omitted from the diagram), and converts the AC (alternating current) power source input from the commercial alternating current power source into the DC (direct current) power source and supplies the needed voltage to each unit. The power supply unit 70 supplies power in compliance with the control order of the control unit 11. The connection between the power supply unit 70 and the commercial alternating current power source can be turned on and off by the main power button of the operation unit 20.

Next, the operation in the first embodiment will be described.

First, the process carried out when the replacement component is replaced will be described.

Figure 4:
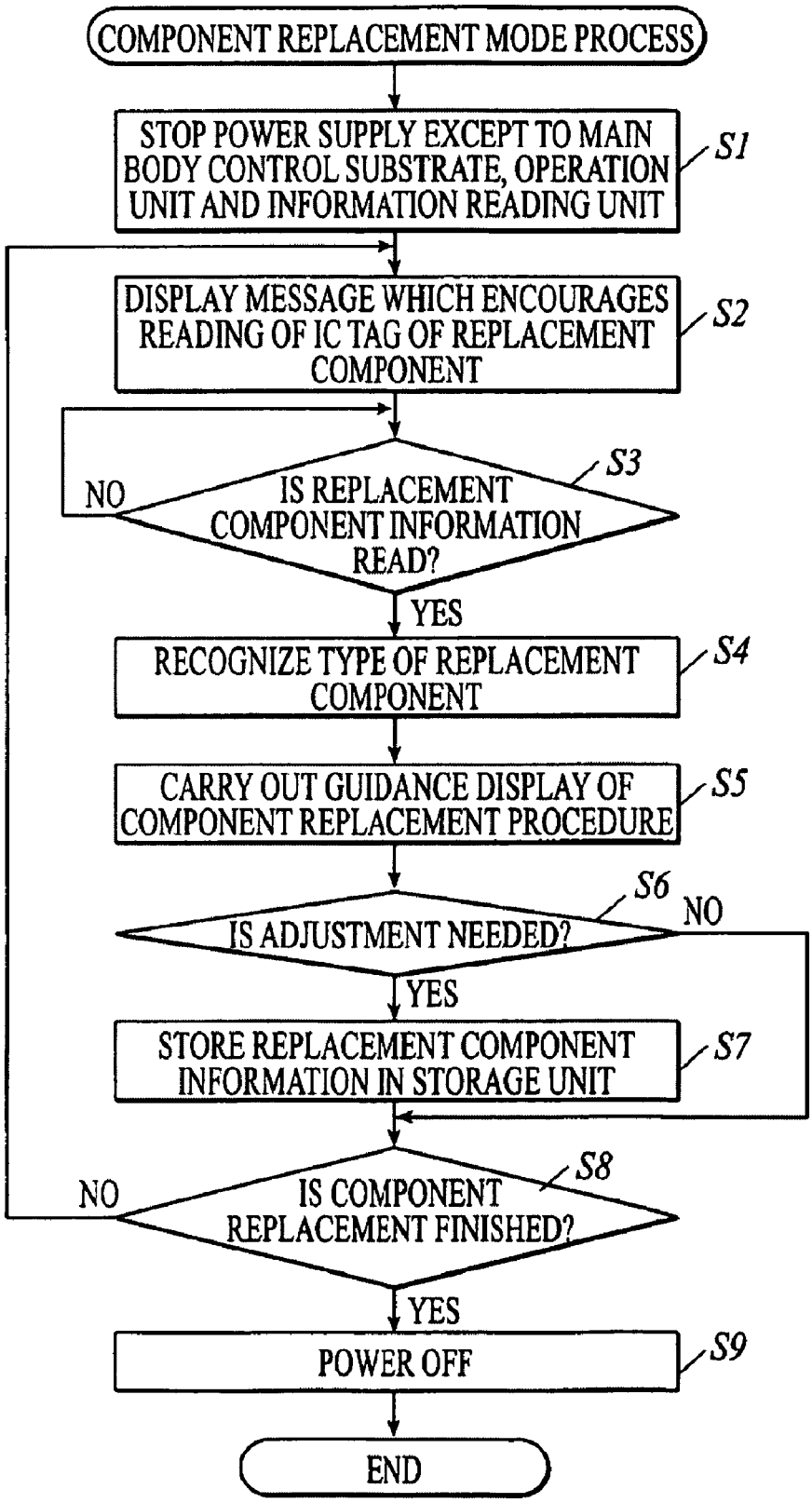
FIG. 4 is a flowchart showing a component replacement mode process which is executed by a control unit of FIG. 1 in the first embodiment.

The component replacement mode process which is executed by the control unit 11 is shown in FIG. 4. The process is a process which is executed when the component replacement mode is set from the operation screen of the operation unit 20.

First, the power supply is stopped except to the main body control substrate 10, the operation unit 20 and the information reading unit 60 (step S1). Next, a message to encourage a user to carry out the reading of the IC tag, such as "Please hold the IC tag of the replacement component over the information reading unit", is displayed on the LCD 22 of the operation unit 20 (step S2). Here, while the apparatus is operating in the component replacement mode, the button of "component replacement finished" to instruct the finishing of the component replacement mode is displayed on the LCD 22.

When the replacement component information is read and input by the information reading unit 60 (step S3; YES), the type of the replacement component to be replaced is recognized based on the component type information of the inputted replacement component information (step S4) and the guidance display of the replacement procedure of the replacement component according to the replacement component to be replaced is carried out on the LCD 22 (step S5).

Subsequently, the necessity of the adjustment after the replacement component is replaced is determined based on the adjustment necessity information of the inputted replacement component information, and the process proceeds to step S8 when it is determined that the adjustment after the replacement component is replaced is not needed (step S6; NO).

On the other hand, when it is determined that the adjustment after the replacement component is replaced is needed based on the adjustment necessity information of the inputted replacement component information (step S6; YES), the inputted replacement component information is stored in the replacement component information file 141 of the storage unit 14 (step S7) and the process proceeds to step S8.

In step S8, whether the "component replacement finished" button on the LCD 22 is pressed or not is determined, and the process returns to step S2 when it is determined that the button is not pressed (step S8; NO). When it is determined that the "component replacement finished" button is pressed (step S8; YES), the power is turned off (step S9) and the process is finished.

As described above, in the control unit 11, the replacement component information is read by the information reading unit 60 and is written in the replacement component information file 141 by the component replacement mode process which is executed when the component replacement mode is set by the operation unit 20. That is, even when the replacement component information is input from the information reading unit 60 in a condition other than the component replacement mode, the replacement component information is not written in the replacement component information file 141 because the above mentioned process is not executed. Therefore, the execution of adjustment based on the information which is read by mistake in a condition other than the component replacement mode in the information reading unit 60, that is, at the time other than when the component replacement is carried out, can be prevented.

Next, the process which is executed when the power is turned on after the replacement component is replaced will be described.

Figure 5:
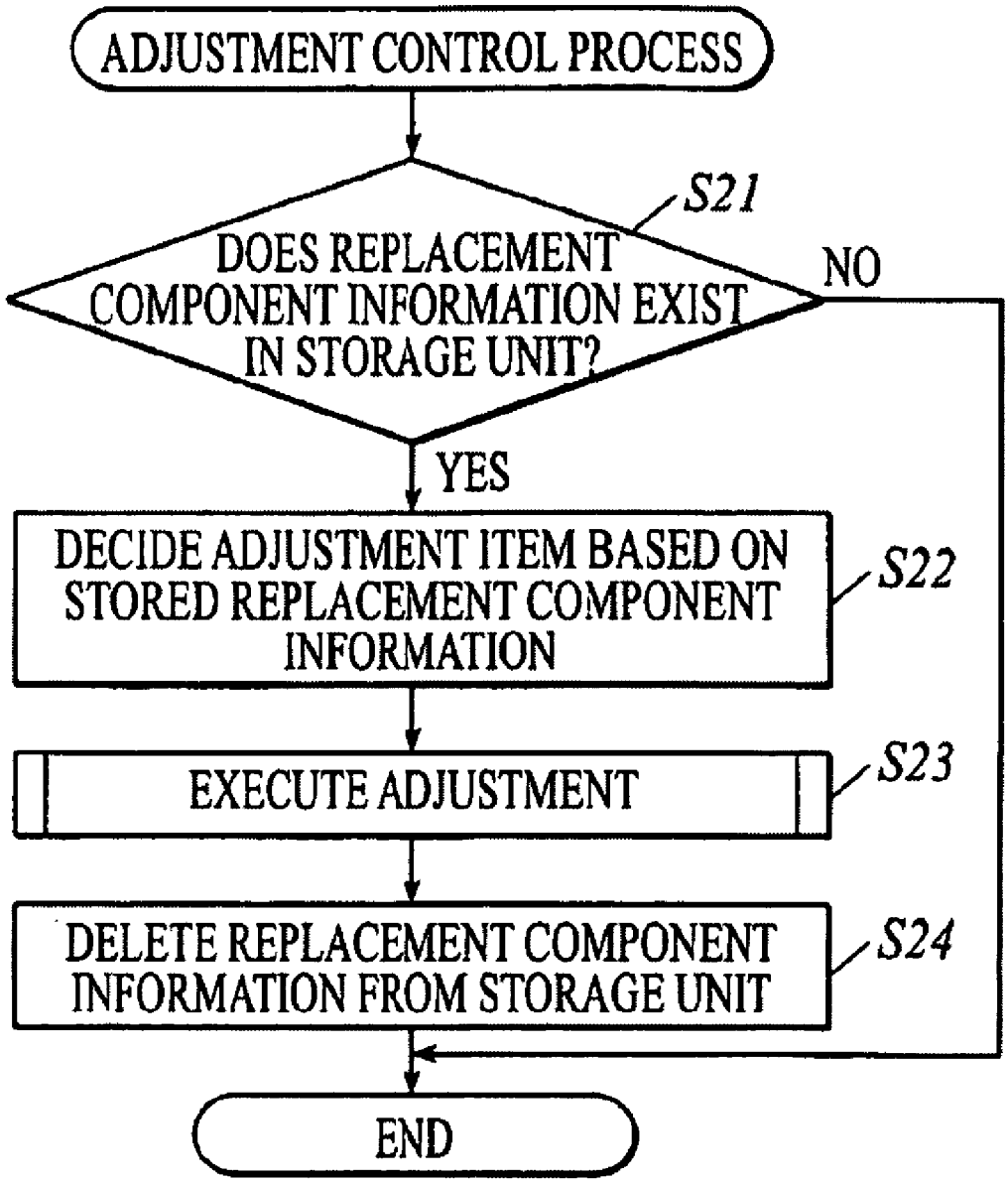
FIG. 5 is a flowchart showing an adjustment process which is executed by the control unit of FIG. 1 in the first embodiment.

The adjustment process which is executed by the control unit 11 is shown in FIG. 5. The process is a process which is executed when the main power button of the operation unit 20 is operated and when the power is turned on (ON).

First, whether the replacement component information is stored in the replacement component information file 141 of the storage unit 14 or not is determined by referring to the file, and the process is finished when it is determined that the replacement component information is not stored (step S21; NO).

On the other hand, when it is determined that the replacement component information is stored in the replacement component information file 141 of the storage unit 14 (step S21; YES), the adjustment item which is needed to be executed is decided (step S22) based on the adjustment item information included in the stored replacement component information and the adjustment of the decided adjustment item is executed (step S23). Particularly, the item which is indicated by the adjustment item information included in the replacement component information stored in the replacement component information file 141 is decided as the adjustment item which is needed to be executed, and the adjustment program of the decided adjustment item is read and the adjustment is executed. Then, after the adjustment is finished, the replacement component information stored in the replacement component information file 141 of the storage unit 14 is deleted (step S24) and the process is finished.

As described above, according to the image forming apparatus 100 of the first embodiment, the IC tag 80 in which the replacement component information including the adjustment necessity information and the adjustment item information is stored is attached to the replacement component to be set at the time of replacement. When switching to the component replacement mode is instructed, the replacement component information stored in the IC tag 80 of the replacement component is read by the information reading unit 60 and the read replacement component information is stored in the replacement component information file 141 of the storage unit 14 by the execution of the component replacement mode process. When the power is turned on, the adjustment process is executed, the item which needs to be adjusted is decided based on the replacement component information stored in the replacement component information file 141, and the adjustment is executed. After the adjustment is finished, the replacement component information stored in the replacement component information file 141 is deleted.

Accordingly, the adjustment which is needed after the component replacement can be automatically executed by just holding the IC tag 80 attached to the replacement component over the information reading unit 60. Therefore, there is no need for a user or a serviceman to select the replacement component to be replaced and the adjustment item which needs to be adjusted along with the replacement of the replacement component from the operation unit, and work of a user or a serviceman according to the replacement of the replacement component can be reduced and the missing of the needed adjustment can be prevented.

There is a case where the needed adjustment item is changed due to the version update or the like of the replacement component even when the replacement component is the same type. However, even in such case, the adjustment according to the changed adjustment item can be automatically executed when the replacement component is replaced by writing the changed adjustment item in the IC tag 80 at the time of shipment of the component from the factory or the like. Therefore, there is no need for a user or a serviceman to carry out a work such as updating the software in the image forming apparatus 100 side or the like when the adjustment item is changed as in the conventional case, and a hassle of a user or a serviceman when the adjustment item is changed can be reduced. Further, missing of the work can be prevented and the needed adjustment can be executed without missing it when the replacement component is replaced.

Second Embodiment

Hereinafter, the second embodiment of the present invention will be described. The structure of the image forming apparatus 100 in the second embodiment is similar to the structure described in the first embodiment. Therefore, the description is omitted and the operation in the second embodiment will be described.

Figure 6:
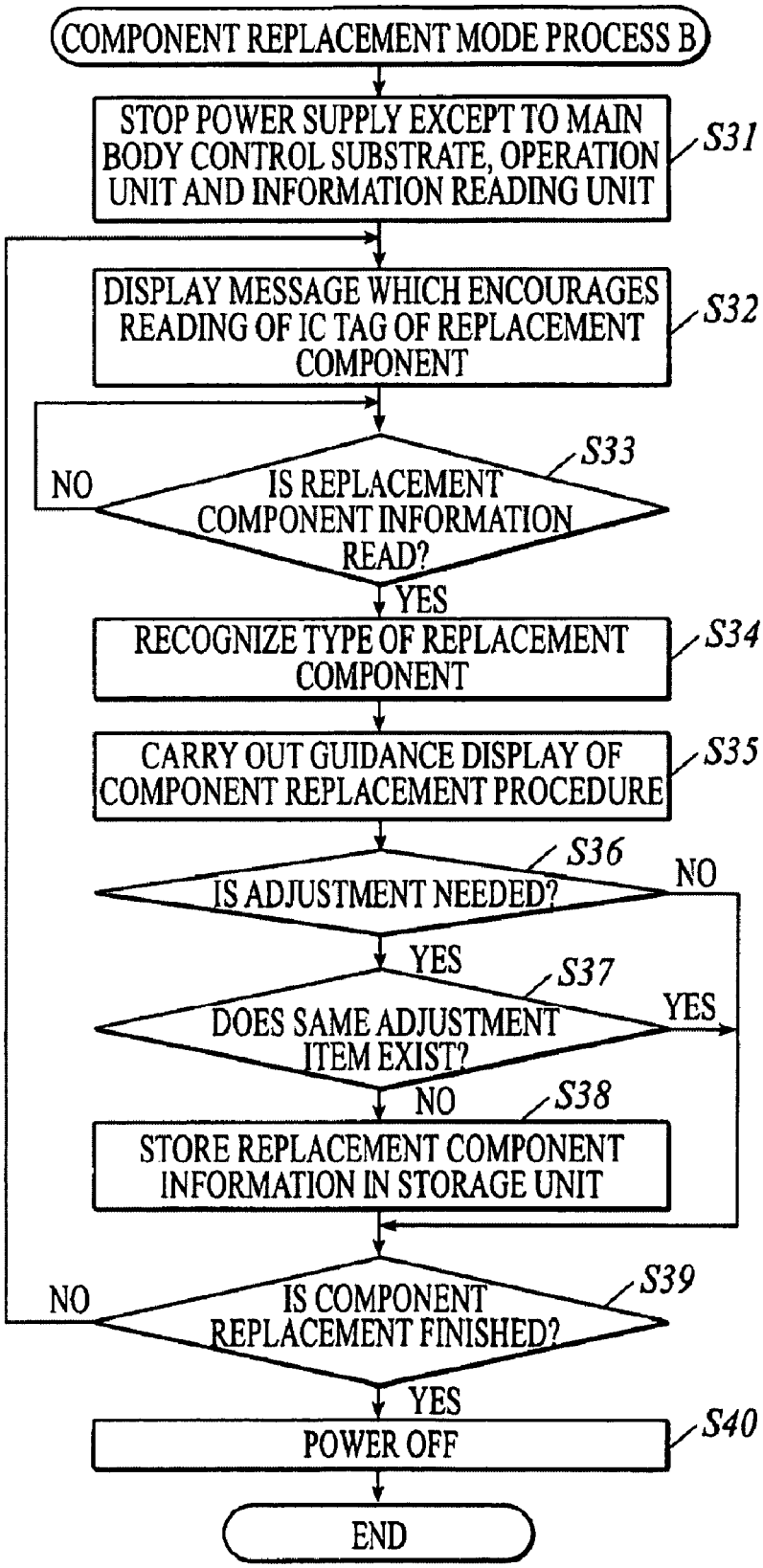
FIG. 6 is a flowchart showing a component replacement mode process B which is executed by the control unit of FIG. 1 in the second embodiment.

The component replacement mode process (will be called the component replacement mode process B to discriminate from the first embodiment) to be executed by the control unit 11 in the second embodiment is shown in FIG. 6. The process is a process which is executed when the component replacement mode is set from the operation screen of the operation unit 20.

First, the power supply is stopped except to the main body control substrate 10, the operation unit 20 and the information reading unit 60 (step S31). Subsequently, a message to encourage a user to carry out the reading of the IC tag 80, such as "Please hold the IC tag of the replacement component over the information reading unit", is displayed on the LCD 22 of the operation unit 20 (step S32). Here, while the apparatus is operating in the component replacement mode, the "component replacement finished" button to instruct the finishing of the component replacement mode is displayed on the LCD 22.

When the replacement component information is read and input by the information reading unit 60 (step S33; YES), the type of the replacement component to be replaced is recognized (step S34) based on the component type information of the replacement component information which is input and the guidance display of the component replacement procedure according to the replacement component to be replaced is carried out on the LCD 22 (step S35).

Then, whether the adjustment after the replacement component is replaced is needed or not is determined based on the adjustment necessity information of the replacement component information which is input, and the process proceeds to step S39 when it is determined that the adjustment after the replacement component is replaced is not needed (step S36; NO).

On the other hand, when it is determined that the adjustment after the replacement component is replaced is needed based on the adjustment necessity information of the inputted replacement component information (step S36; YES), whether the adjustment item information same as the inputted adjustment item information of the replacement component information which is input by the information reading unit 60 is already stored in the replacement component information file 141 stored in the storage unit 14 or not is determined by referring to the file, and the process proceeds to step S39 when it is determined that the same adjustment item information is stored in the file (step S37; YES). When it is determined that the adjustment item information same as the adjustment item information of the replacement component information which is input by the information reading unit 60 is not stored in the storage unit 14 (step S37; NO), the inputted replacement component information is stored in the replacement component information file 141 of the storage unit 14 (step S38) and the process proceeds to step S39.

In step S39, whether the "component replacement finished" button on the LCD 22 is pressed or not is determined, and the process returns to step S32 when it is determined that the button is not pressed (step S39; NO). When it is determined that the "component replacement finished" button is pressed (step S39; YES), the power is turned off (step S40) and the process is finished.

The adjustment process which is executed when the power is tuned on after the replacement component is replaced is similar to the process described in the first embodiment.

As described above, in the second embodiment, the replacement component information is newly stored in the storage unit 14 only when the adjustment item same as the adjustment item information included in the replacement component information read by the information reading unit 60 is not stored in the replacement component information file 141 of the storage unit 14. That is, the replacement component information is additionally stored in the replacement component information file 141. For example, there is a need to carry out the color resist adjustment after the optical unit 40Y is and the image forming unit 50Y is replaced. However, when the optical unit 40Y is replaced and the image forming unit 50Y is replaced thereafter, the color resist adjustment is already stored in the storage unit 14 as the adjustment item when the image forming unit 50Y is replaced. Therefore, the replacement component information read from the IC tag 80 of the image forming unit 50Y is not stored in the storage unit 14. Thus, the color resist adjustment is executed only one time when the power is turned on the next time, and a plurality of times of execution of the color resist adjustment is omitted. By executing such control by the control unit 11, redundantly executing the adjustment of the same adjustment item can be prevented in the execution of the adjustment when the power is turned on.

Third Embodiment

Hereinafter, the third embodiment of the present invention will be described.

First, the structure of the third embodiment will be described.

In the third embodiment, the storage unit 14 includes the component management information file 142 in addition to the replacement component information file 141.

An example of the data storage of the component management information file 142 is shown in FIG. 7. The component management information file 142 is a file to store the information (setting component information) relating to the replacement component set in the printer 52. For example, the identification information (component type information) to specify the type of the component and the individual identification information (for example, serial number) to uniquely specify the replacement component are included in the set component information. As shown in FIG. 7, the component management information file 142 has the "component type information" field to store the component type information, the "serial number" field to stored the serial number and the like, and retains the individual identification information of the replacement component which was set right after the adjustment due to the previous component replacement by being updated right after the execution of the adjustment by the control unit 11.

Moreover, in the embodiment, the serial number which is the individual identification information of the replacement component in which the IC tag 80 is attached is recorded in the IC tag 80.

The other structure of the image forming apparatus 100 is similar to the structure described in the first embodiment. Therefore, the description is omitted.

Next, the operation in the third embodiment will be described.

The process carried out when the replacement component is replaced in the third embodiment is similar to the component replacement mode process described by using FIG. 4 in the first embodiment. Therefore, the description is omitted.

Hereinafter, the process which is executed when the power is turned on after the replacement component is replaced will be described.

Figure 8:
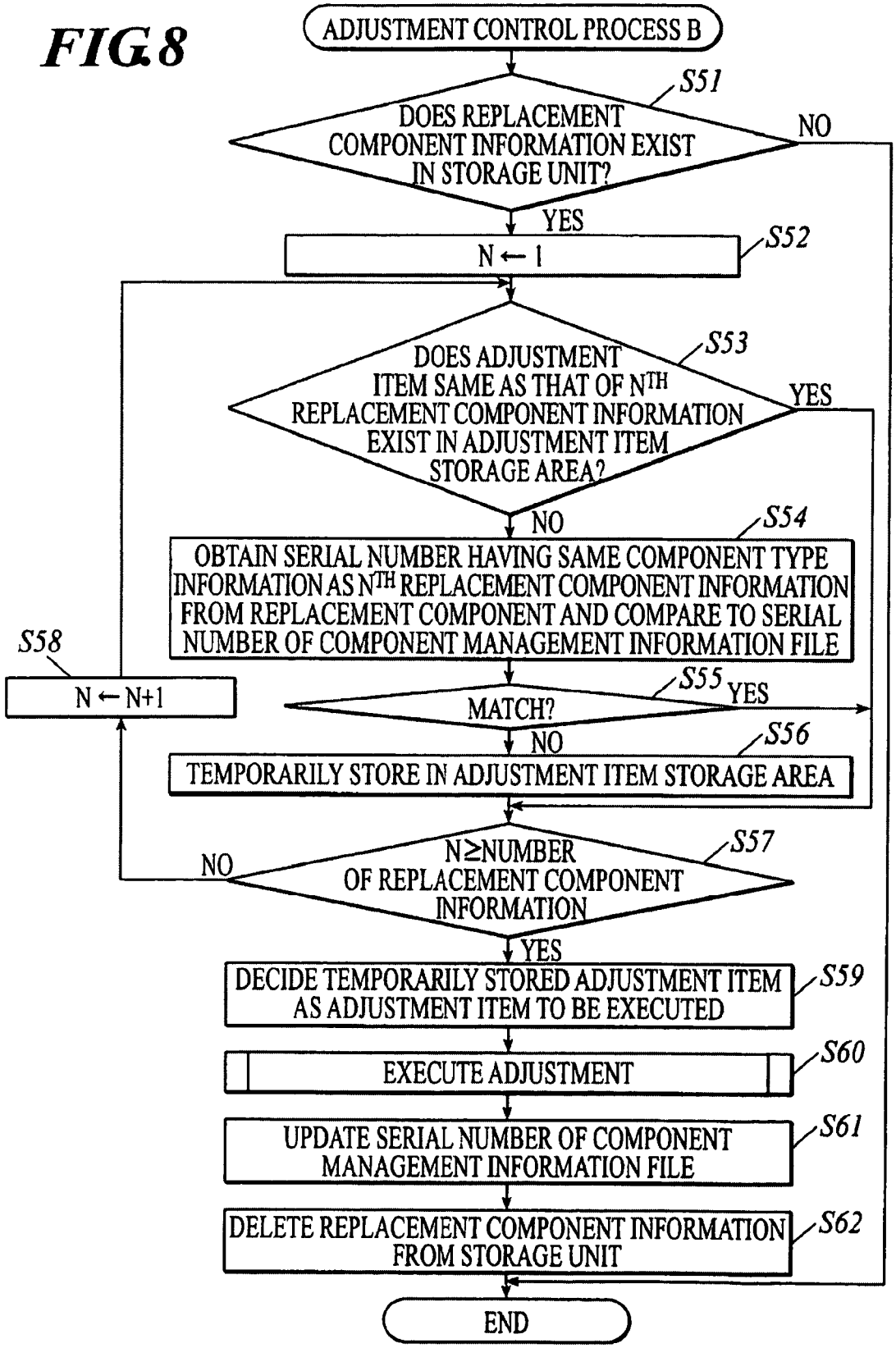
FIG. 8 is a flowchart showing an adjustment process B which is executed by the control unit of FIG. 1 in the third embodiment.

The adjustment process (will be called the adjustment process B to discriminate from the adjustment process of the first embodiment) which is executed by the control unit 11 is shown in FIG. 8. The process is a process which the main power button of the operation unit 20 is operated and when the power is turned on.

First, whether the replacement component information is stored in the replacement component information file 141 of the storage unit 14 or not is determined by referring to the file, and the process is finished when it is determined that the replacement component information is not stored (step S51; NO).

On the other hand, when it is determined that the replacement component information is stored (step S51; YES), 1 is set as the counting value n (step S52) and whether the adjustment item information which is same as the adjustment item information of the $n^{th}$ replacement component information in the replacement component information file 141 is stored in the adjustment item storage area assured in the RAM or not is determined. When it is determined that the adjustment item information which is same as the adjustment item information of the $n^{th}$ replacement component information is stored in the adjustment item storage area (step S53; YES), the process proceeds to step S57.

When it is determined that the adjustment item information which is same as the adjustment item information of the $n^{th}$ replacement component information is not stored in the adjustment item storage area (step S53; NO), the serial number is obtained from the IC tag 80 in which the component type information that matches with the component type information of the $n^{th}$ replacement component information is recorded by the information reading unit 60 (step S54). That is, the serial number is obtained from the replacement component which is the same type as the replacement component of which the replacement component information is stored in the storage unit 14 by being considered as being replace by a replacement component, and which is the replacement component set in the image forming apparatus 100. Here, the communication distance between the information reading unit 60 and the IC tag 80 in step 54 needs to be longer than the communication distance in the component replacement mode. Therefore, the reading in different communication distances in the component replacement mode and in a condition where the power is turned on is realized by controlling the output of the information reading unit 60 by the control unit 11 or by using the information reading unit 60 of different electric wave output.

Next, the serial number obtained by the information reading unit 60 is compared to the serial number of the component which is the same type stored in the component management information file 142. When it is determined that the serial numbers match as a result of the comparison (step S55; YES), it is determined that the replacement component is not actually replaced and the process proceeds to step S57. When it is determined that the serial numbers do not match (step S55; NO), it is determined that the replacement component has been actually replaced and the adjustment item information of the $n^{th}$ replacement component information is stored in the adjustment item storage area (step S56) and the process proceeds to step S57.

In step S57, whether "n≧the number of replacement component information stored in the replacement component information file 141" is true or not is determined. When it is determined that "n≧the number of replacement component information stored in the replacement component information file 141" is not true (step S57; NO), the counting value n is incremented by 1 (step S58) and the process returns to step S53.

On the other hand, when it is determined that "n≧the number of replacement component information stored in the replacement component information file 141" is true (step S57; YES), the adjustment item to be executed is decided based on the information stored in the adjustment item storage area of the RAM (step S59). Then, the adjustment of the decided adjustment item is executed (step S60).

When the adjustment is finished, the serial number is obtained from the IC tag 80 which is attached to each replacement component set in the image forming apparatus 100 by the information reading unit 60, the component management information file 142 is updated based on the obtained serial number (step S61), the data stored in the replacement component information file 141 is deleted (step S62), and the process is finished. After the process is finished, the adjustment item storage area of the RAM is opened.

As described above, in the third embodiment, the process is controlled so as not to redundantly execute the adjustment of the same adjustment item by the execution of the above described adjustment process B when a plurality of replacement component information including the same adjustment item are stored in the replacement component information file 141. Therefore, execution of unnecessary adjustment process can be prevented. Further, the serial number is obtained from the replacement component which is the same type as the replacement component in which the replacement component information is stored in the storage unit 14 by being considered as being replace by a replacement component, and which is the replacement component set in the image forming apparatus 100 by the information reading unit 60, whether the component has been actually replaced or not is determined based on the obtained serial number, and the adjustment is carried out when it is determined that the component has been actually replaced before the execution of the adjustment. Therefore, execution of unnecessary adjustment can be prevented.

The first to the third embodiments are described above. However, the content of the description of the above embodiments are a preferred example of the image forming apparatus 100 according to the present invention, and it is not limited to this.

For example, in the above embodiments, the case where the IC tag 80 is being used as the recording medium in which the replacement component information is stored and where the information reading unit 60 which reads the replacement component information is acting as the IC tag reader is described as an example. However, the present invention is not limited to this. For example, in the first and the second embodiments, the recording medium may be a bar code which expresses the replacement component information and the information reading unit may be the bar code reader.

Moreover, the order of the replacement may be stored at the same time when the replacement component information is stored in the storage unit 14 so that the adjustment may be executed in the order of replacement of the replacement component.

In the above first to third embodiments, it is described that all the replacement component information is stored in the replacement component information file 141. However, the structure may be so that only the needed information is stored. For example, only the adjustment item information may be stored in the first and the second embodiments, and the component type information and the adjustment item information may be stored in the third embodiment.

In addition, the detail structure and the detail operation of each device which constitutes the image forming apparatus 100 can be arbitrarily changed within the scope of the invention.

The entire disclosure of Japanese Patent Application No. 2007-146495 filed on Jun. 1, 2007 is incorporated herein by reference in it entirely.

What is claimed is:

1. An image forming apparatus in which a replacement component is set, comprising:

the replacement component in which a storage medium storing adjustment necessity information indicating whether an adjustment procedure is needed or not after the replacement component is replaced and adjustment item information indicating an adjustment item is attached;

an information reading unit to read the adjustment necessity information and the adjustment item information from the storage medium when the replacement component is set;

a control unit to execute the adjustment procedure based on the adjustment necessity information and the adjustment item information read by the information reading unit when a power is turned on after the replacement component is replaced; and an operation unit to set an operation mode of the control unit to a component replacement mode, wherein:

the control unit reads the adjustment necessity information and the adjustment item information from the storage medium by the information reading unit in the component replacement mode, and power supply is stopped except to units needed for reading the adjustment necessity information and the adjustment item information in the component replacement mode.

2. The image forming apparatus of claim 1, wherein in a case where same adjustment items exist in the adjustment items to be executed when a plurality of replacement components are replaced, the control unit executes the adjustment procedure for only one time by omitting a plurality of times of adjustment procedures relating to the same adjustment item.

3. The image forming apparatus of claim 1, wherein the storage medium further stores individual identification information of the replacement component, and when the power is turned on after the replacement component is replaced, the control unit obtains the individual identification information stored in the storage medium by the information reading unit, determines whether the replacement component has been actually replaced or not based on the obtained individual identification information, and executes the adjustment procedure when the control unit determines that the replacement component has been actually replaced.

4. The image forming apparatus of claim 1, wherein the information reading unit stores the adjustment item information when it is determined that the adjustment procedure is needed according to the adjustment necessity information and does not store the adjustment item information when it is determined that the adjustment procedure is not needed according to the adjustment necessity information.

5. An adjustment method of an image forming apparatus in which a replacement component is set, comprising:

reading adjustment necessity information indicating whether an adjustment procedure is needed or not after a replacement component is replaced and adjustment item information indicating an adjustment item from a storage medium attached to the replacement component by an information reading unit when the replacement component is set;

executing the adjustment procedure based on the adjustment necessity information and the adjustment item information which are read when a power is turned on after the replacement component is replaced;

setting an operation mode to a component replacement mode by an operating unit; and stopping power supply except to units needed for reading the adjustment necessity information and the adjustment item information in the component replacement mode, wherein the adjustment necessity information and the adjustment item information are read in the reading when the component replacement mode is set in the setting.

6. The adjustment method of the image forming apparatus of claim 5, wherein in a case where same adjustment items exist in the adjustment items to be executed when a plurality of replacement components are replaced, the adjustment procedure is executed for only one time by omitting a plurality of times of adjustment procedures relating to the same adjustment item.

7. The adjustment method of the image forming apparatus of claim 5, wherein the storage medium further stores individual identification information of the replacement component, and the executing of the adjustment procedure includes obtaining the individual identification information from the storage medium by the information reading unit when the power is turned on after the replacement component is replaced, determining whether the replacement component has been actually replaced or not based on the obtained individual identification information and executing the adjustment procedure when it is determined that the replacement component has been actually replaced.

8. The adjustment method of the image forming apparatus of claim 5, wherein the information reading unit stores the adjustment item information when it is determined that the adjustment procedure is needed according to the adjustment necessity information and does not store the adjustment item information when it is determined that the adjustment procedure is not needed according to the adjustment necessity information.

* * * * *